US006445267B1

(12) United States Patent
Stephan

(10) Patent No.: US 6,445,267 B1
(45) Date of Patent: Sep. 3, 2002

(54) TUNER FOR CAVITY RESONATOR

(75) Inventor: Juergen Stephan, Dresden (DE)

(73) Assignee: Forschungszentrum Rossendorf e.V., Schoenfeld-Weissig (DE)

( * ) Notice: Subject to any disclaimer, the term of this patent is extended or adjusted under 35 U.S.C. 154(b) by 0 days.

(21) Appl. No.: 09/590,762

(22) Filed: Jun. 8, 2000

(30) Foreign Application Priority Data

Jul. 22, 1999 (DE) ..... 199 34 392

(51) Int. Cl.[7] ..... H01P 7/06
(52) U.S. Cl. ..... 333/232; 333/231; 333/235
(58) Field of Search ..... 333/231, 232, 333/235

(56) References Cited

U.S. PATENT DOCUMENTS 4,178,562 A * 12/1979 Torma et al. ..... 331/84

OTHER PUBLICATIONS

Tesla Report No. 96–09, Deutsches Elektronen–Synchrotron Hamburg, p. 2, Mar. 29–30, 1996.
Tesla Report No. 95–01, Deutsches Elektronen–Synchrotron Hamburg, p. 174, Mar. 1, 1995.
Proceedings of the CERN Accelerator School No. 89–04, 30.5–3.6 1988, pp. 224–226 CERN, Geneva.
Proceedings of the 2nd Workshop on Rf Superconductivity, Jul. 23 to 27, 1984, Part 1, p. 85, CERN, Geneva.
Proceedings of the CERN Accelerator School No. 89–04, 30.5–3.6. 1988, p. 174, CERN, Geneva.
Proceedings of the 6th Workshop on Rf superconductivity, Oct. 4th to 8th, 1993, vol. 2, p. 1074, CERN, Geneva.

* cited by examiner

*Primary Examiner*—Robert Pascal
*Assistant Examiner*—Stephen E. Jones
(74) *Attorney, Agent, or Firm*—Jordan and Hamburg LLP

(57) ABSTRACT

It is an object of the invention to propose a mechanical gearing for a tuner for cavity resonators, which can be realized and operated in a less expensive version and with long service life and little backlash even at very low temperatures. At the same time, there is no piezoelectric or magnetostrictive driving mechanisms or their combinations with coarse driving mechanisms. The tuner includes a multi-stage lever mechanism, for which the fulcrum and the movable connecting site are integral and are connected over a narrow cross member. The connecting sites between the stages of the multi-stage lever mechanism are constructed as a bolt-shaped part, the ends of which are firmly connected with one stage and the middle part of which is connected with the other stage.

18 Claims, 5 Drawing Sheets

TUNER FOR CAVITY RESONATOR

BACKGROUND OF THE INVENTION

The invention relates to a tuner for cavity resonators by the controlled, non-destructive deformation of stiff hollow bodies, especially for adjusting the oscillation frequency of superconducting resonators.

A tuner for cavity resonators is already known, for which one or several geared spindle drives, which compress or extend the resonator (Tesla Report No. 96-09, Deutsches Elektronen-Synchrotron Hamburg, page 2: Proceedings of the CERN Accelerator School No. 89-04, 30.5–3.6. 1988, pages 224–226 CERN, Geneva), and are coupled mechanically in the same direction, are disposed about the effective axis.

It is also known that a one-stage or multi-stage lever mechanism, which is moved by a geared spindle drive, may be used (Proceedings of the $2^{nd}$ Workshop on Rf Superconductivity, Jul. 23 to 27, 1984, Part 1, page 85, CERN, Geneva).

Furthermore, a construction is known, for which the load arm engages the front side of the resonator, while all lever fulcrums are connected with the rear side of the resonator (Tesla Report No. 95-01, Deutsches Elektronen-Synchrotron Hamburg, page 174).

In such mechanical gearings, different rotary bearings, provided with sliding layers, are used, which can be operated only in a very expensive construction and with very expensive maintenance, especially in a vacuum and at a temperature close to absolute zero. Under the conditions of use named, these bearings do not attain the required service life and absence of play.

If appropriately constructed, a piezostrictive driving mechanism can attain the required resolution, but not, at the same time, the required large displacement path and a high driving force. Such driving mechanisms are therefore frequently connected downstream from a coarsely working mechanical driving mechanism (Proceedings of the CERN Accelerator School No. 89-04, 30.5–3.6. 1988, page 174, CERN, Geneva). At the same time, the costs and the space required increase. Over the operating time of this driving mechanism, the driving energy must be maintained constantly and kept extremely constant. The inherent hysteresis also has a disadvantageous effect on the operation of such a driving mechanism. The tuning result is lost when the driving energy is switched off. Because of the decreasing effect and the mechanical unreliability, the use of piezostrictive driving mechanisms at temperatures close to absolute zero is not possible.

A magnetostrictive driving mechanism is also known (Proceedings of the $6^{th}$ Workshop on Rf superconductivity, Oct. $4^{th}$ to $8^{th}$, 1993, vol. 2, page 1074, CERN, Geneva). This driving mechanism requires a large structural length for producing the required adjustment path. Several such driving mechanisms must be connected in parallel in order to produce simultaneously the high adjusting force that is required. Since the characteristic action lines deviate from one another, there is an additional expense for adapting the characteristic lines when such driving mechanisms are connected in parallel. The self-magnetic field of such driving mechanisms interferes with the behavior of the suprconducting resonators. Here also, for the time that this driving mechanism is working, the driving energy must be maintained constantly and kept extremely constant and the tuning result is lost when the driving energy is switched off.

SUMMARY OF THE INVENTION

It is therefore an object of the invention to propose a mechanical gearing for a tuner for cavity resonators, which can be realized and operated in a less expensive version and the long service life and little backlash of which are assured even at very low temperatures. At the same time, the piezoelectric or magnetostrictive driving mechanisms or their combinations with coarse driving mechanisms shall be omitted.

Pursuant to the invention, the objective is accomplished with a first lever member mounted to effect movement of a resonator, having an arm; a second lever member pivotably connected to the resonator; and a torsoinal deflecting member connecting said first lever member and said second lever member.

Aside from the objectives listed, a regulating distance of a few tenth of a millimeter with a resolution of about a few nanometers at a regulating power of more than 2,000 N can be attained reproducibly with the use of the invention and the tuning position is retained even after the driving energy is switched off. These conditions are maintained even in little space.

BRIEF DESCRIPTION OF THE DRAWINGS

The invention is described in greater detail in the following. In the associated drawings.

DETAILED DESCRIPTION OF THE INVENTION

Figure 1:
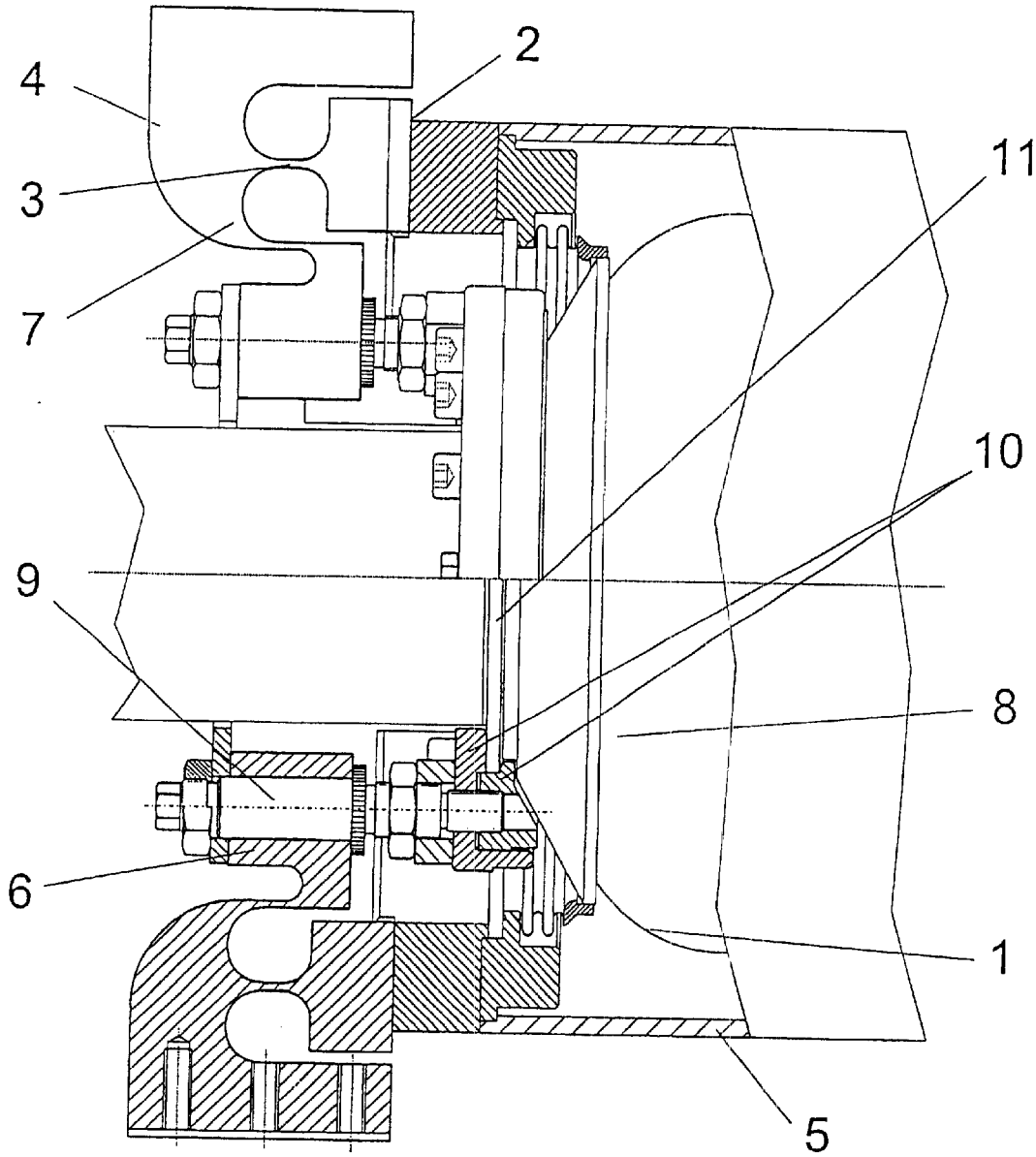
FIG. 1 shows a longitudinal section through connecting sites of a lever mechanism.

A longitudinal section through connecting sites of a lever mechanism with a resonator 1 shows a rigid, immovable connecting site 2 of a fulcrum 3 of a first stage 4 of the lever mechanism in a housing 5 are shown in FIG. 1. The connection of which with an end of the resonator 1, which cannot be adjusted, is not shown.

In this connection, the fulcrum 3 is constructed as a band-shaped bending zone, within which a functional fulcrum is formed during action. Due to the reaction forces of the resonator 1, this band-shaped bending zone is subjected to a compressive or tensile stress of up to 2,500 N. The flexible coupling with the adjustable end of the resonator 1 is brought about over a movable connecting site 6 of a load arm 7 of the first stage 4 of the lever mechanism. A rigid connection with a deformable part 8 of the resonator 1 is accomplished over adjustable coupling bolts 9 and over segmented, self-centering retaining rings 10 with a end ring 11 formed at an outer wall of the resonator 1. The coupling bolt 9 permits the working point of the complete tuner to be shifted with respect to the resonance point of the resonator 1.

Figure 2:
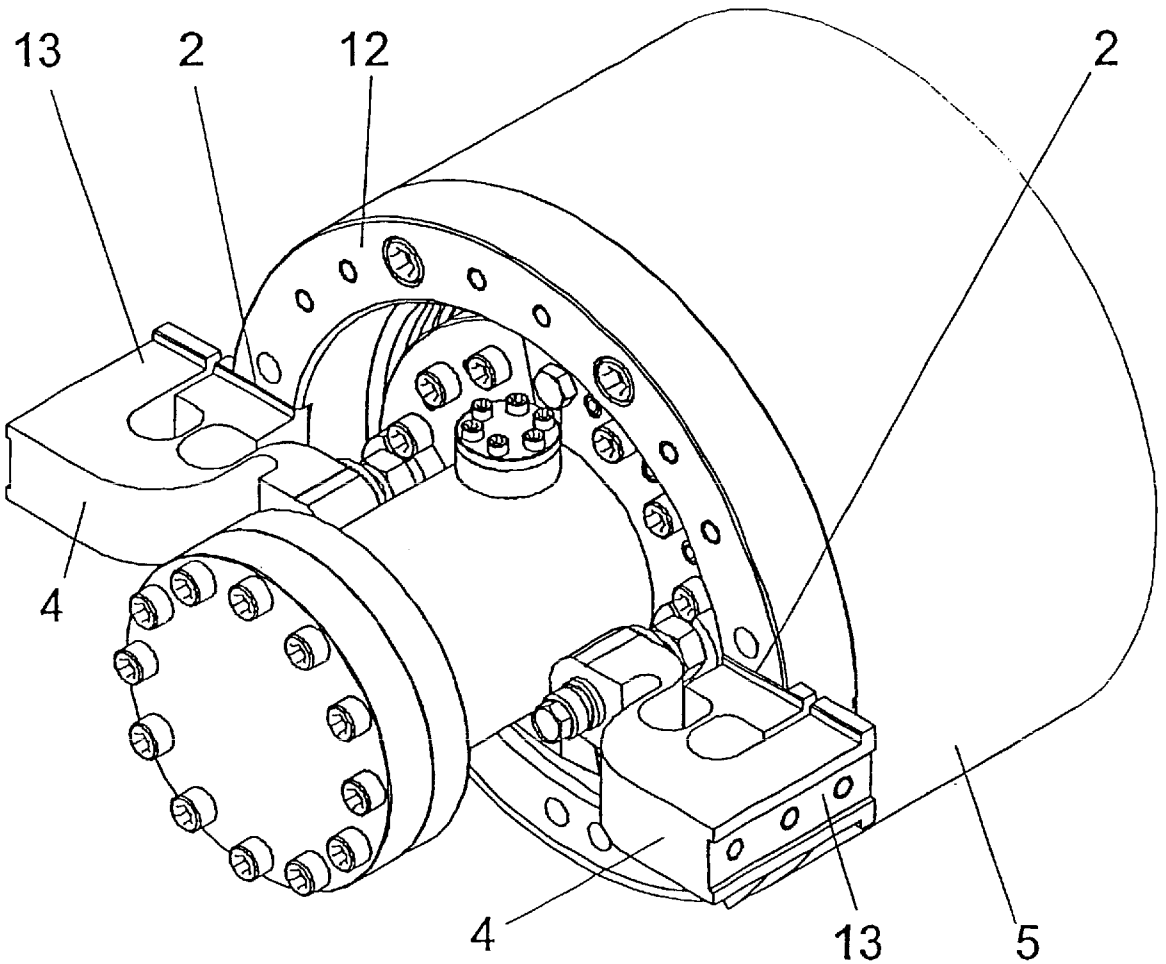
FIG. 2 shows the perspective view of a tuner.

In FIG. 2, the resonator 1 cannot be seen. It is within the housing 5. For reasons of redundancy and symmetry, there are two first stages 4 of the lever mechanism on the connecting sites 2 to the housing 5, which are constructed as base ring 12. For manufacturing and installation reasons, a power arm 13 of the first stage 4 of the paired lever mechanism is divided. It is connected there in each case rigidly with a lever mechanism 17 with a power arm extension 14 during the mounting of the second stage of the lever mechanism 17.

Figure 3:
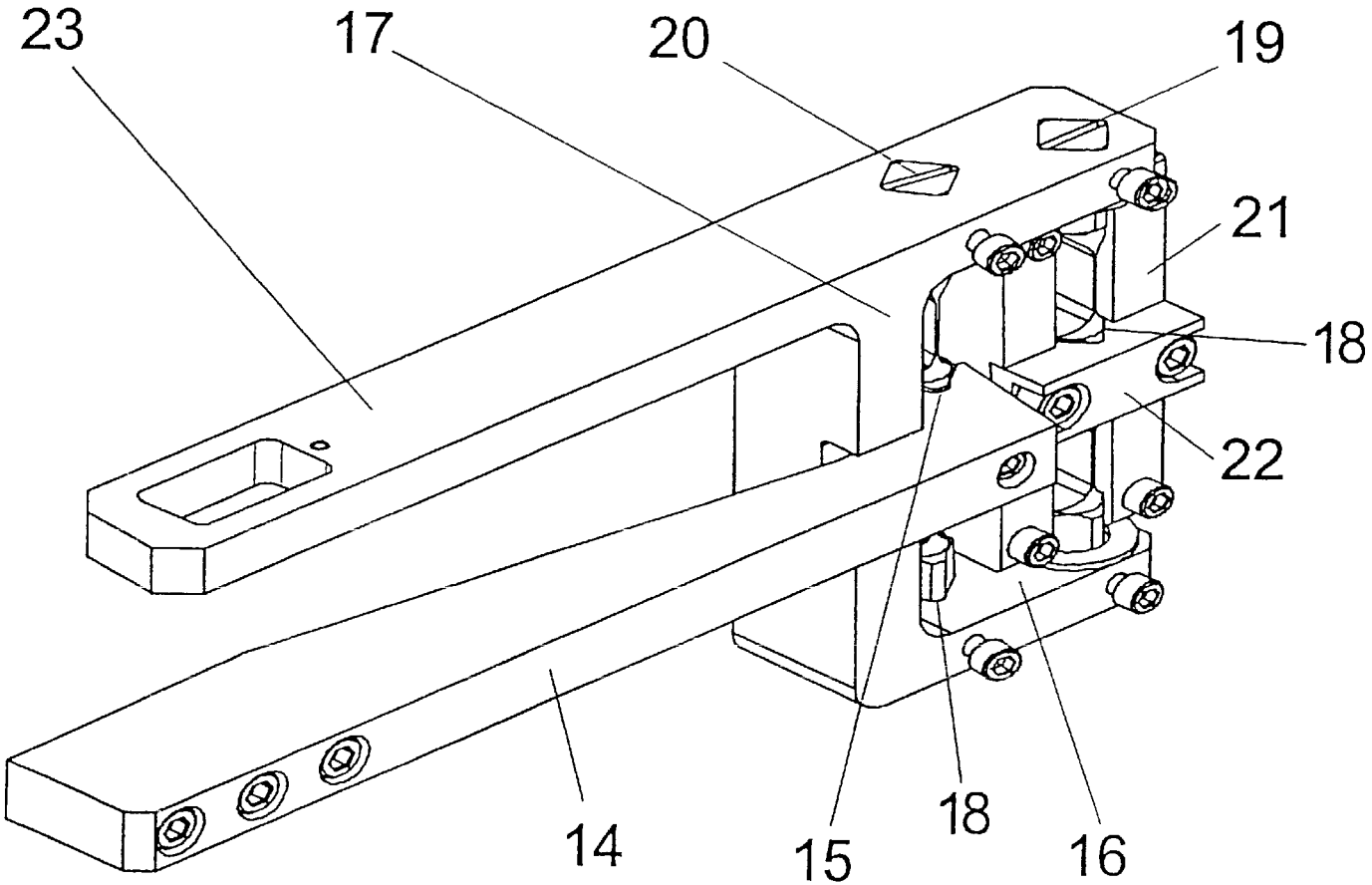
FIG. 3 shows a second stage of the lever mechanism.
Figure 4:
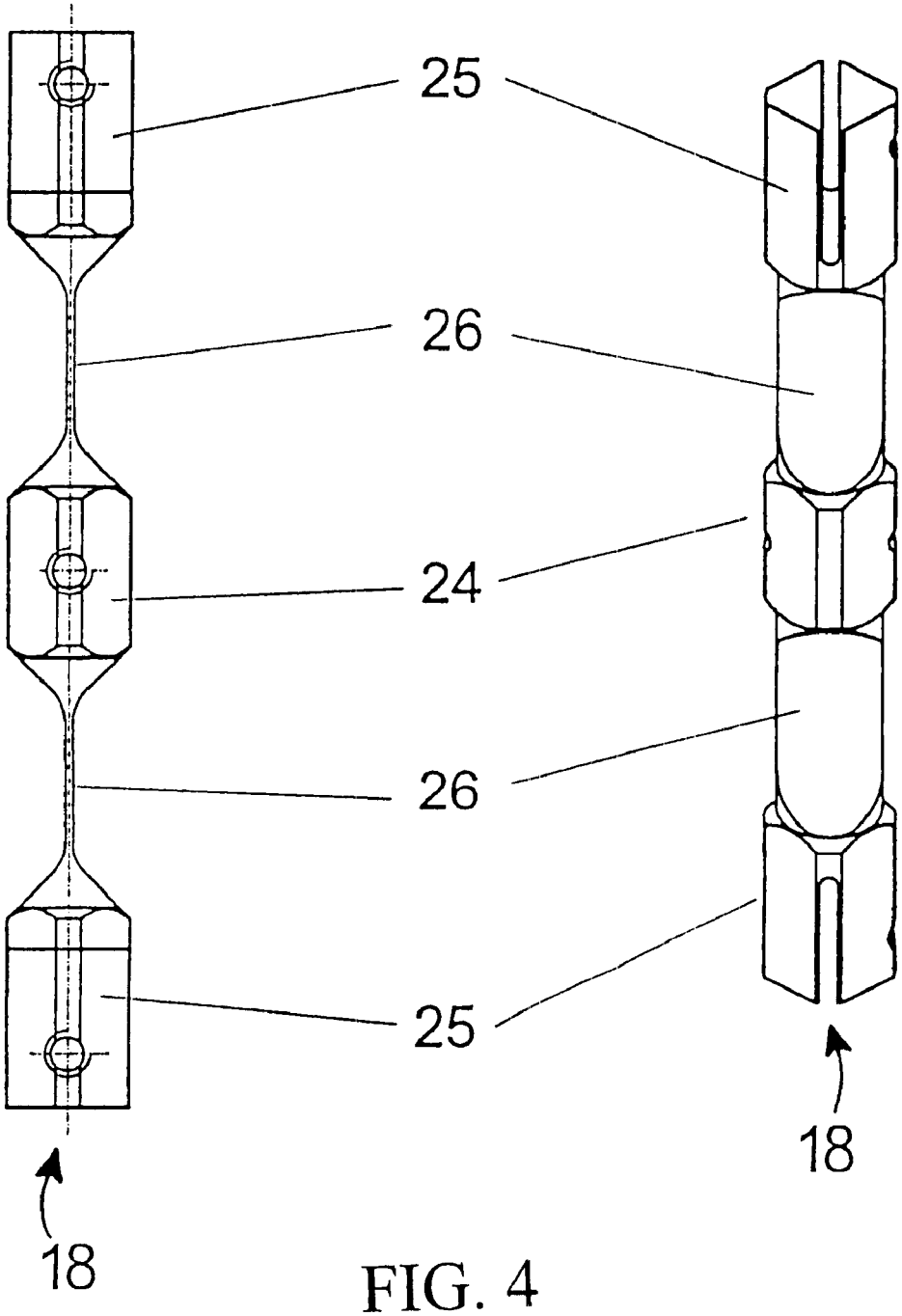
FIG. 4 shows a construction of a torsion bolt.

The second stage 17 of the lever mechanism includes a work arm 16 and a power arm 23. A coupling 15 of the power arm extension 14 to the work arm 16 of the second stage 17 of the lever mechanism is shown there. In this stage, the rotary bearings are replaced by band-shaped torsion bolts 18, see FIGS. 3–5. These bolts form a axis of rotation 19 of the lever of the second stage 17 of the lever mechanism, as well as a flexible coupling 20 between the first stage 4 and the second stage 17 of the lever mechanism. The rigid connection with the connecting site 2, which is not shown, is accomplished over the housing 5, which is not shown and to which the bearing block 21 is rigidly attached. The clamp 22 is used for holding the torsion bolt 18 rigidly in the bearing block 21. The left first stage of the lever mechanism is complementary to the right first stage 17.

Preferably, the torsion bolt 18 is constructed as a square bolt. In operation, a central clamping region 24 of the torsion bolt is twisted with respect to two outer clamping regions 25, band shaped regions 26 twisting elastically. At the clamping region 24, the power arm extension 14 of the first stage 4 is rigidly coupled positively or fastened rigidly in the bearing block 21 with the housing 5 by means of the clamp 22. The clamping region 25 is rigidly connected positively or by soldering or welding with the second stage 17. At the same time, the radial orientation is fixed so that the action forces of the lever mechanism in the middle register position of the tuner act as transverse forces against the larger moment of resistance of the band-shaped region 26, and the latter, when the tuner is functioning, is twisted equally in both adjusting directions.

Figure 5:
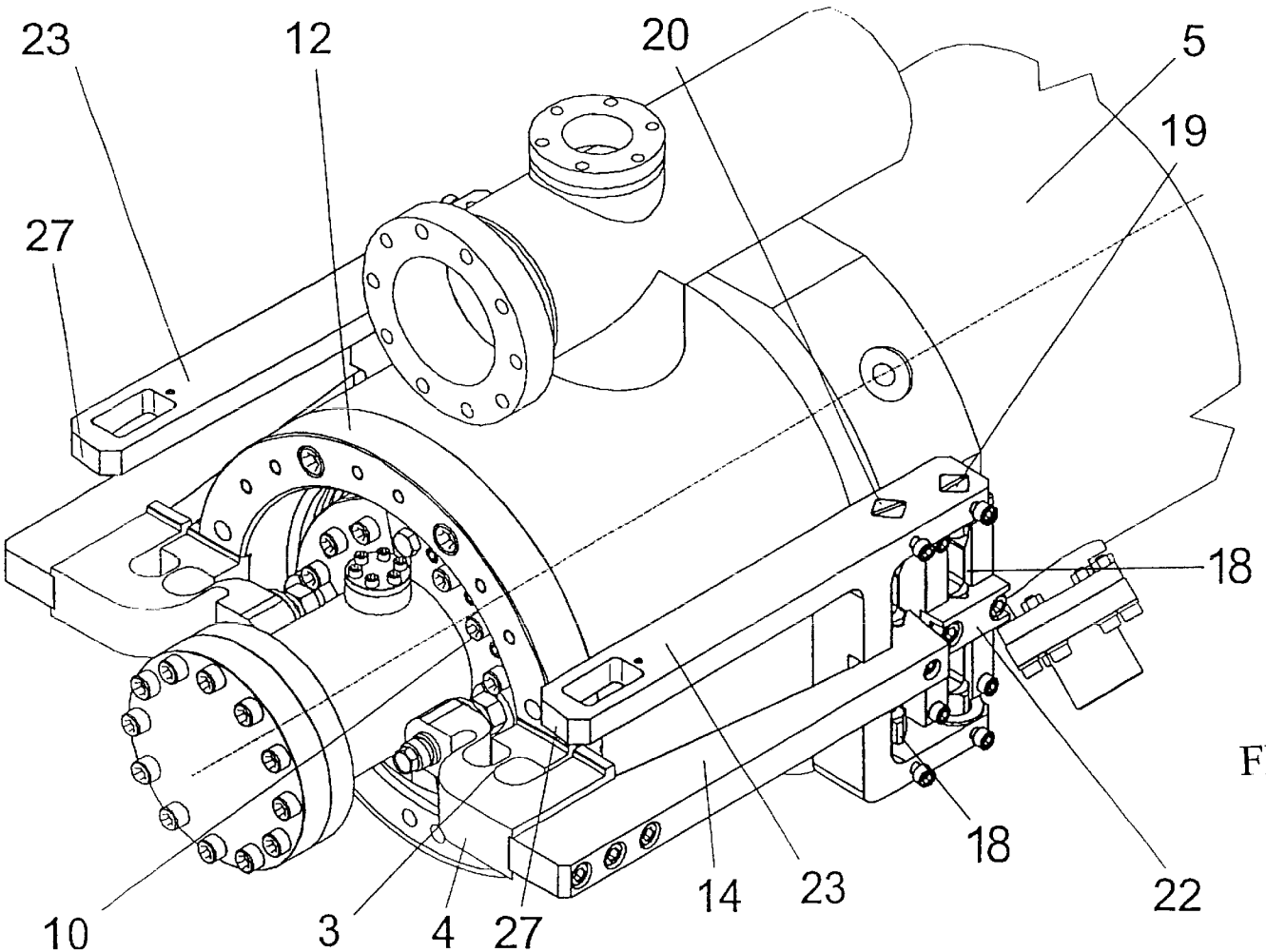
FIG. 5 shows a variation of the complete tuner.

The complete tuner is shown in FIG. 5. During the operation of the tuner, ends 27 of the power arms 23 are moved towards or away from one another.

What is claimed is:

1. A tuner apparatus for a cavity resonator having a displaceable member for effecting tuning, comprising:

a first lever member mounted to effect movement of the displaceable member of the cavity resonator;

said first lever member having an arm;

a second lever member pivotably connected to the resonator;

a torsionally deflecting member connecting said first lever member and said second lever member to permit movement of said first lever member by said second lever member, thereby effecting movement of said displaceable member and tuning said cavity resonator.

2. The tuner apparatus according to claim 1, wherein the a second lever member is pivotably connected to the resonator by a second torsionally deflecting member.

3. The tuner apparatus according to claim 2, wherein the second torsionally deflecting member is a torsional bolt.

4. The tuner apparatus according to claim 2, wherein the second torsionally deflecting member is a band shaped torsional bolt.

5. The tuner apparatus according to claim 1, wherein the torsionally deflecting member is a torsional bolt.

6. The tuner apparatus according to claim 1, wherein the torsionally deflecting member is a band shaped torsional bolt.

7. The tuner apparatus for a cavity resonator according to claim 1, wherein the torsionally deflecting member has a first connecting region for connecting to the first lever member, a second connecting region for connecting to the second lever member and a center region, said center region joins the first connecting region and the second connecting region and is torsionally deflectable.

8. The tuner apparatus according to claim 7, wherein said second connecting region includes two connecting regions which are joined to the first connecting region by the center region and a second center region, and said second center region is torsionally deflectable.

9. The tuner apparatus according to claim 8, wherein the center region and the second center region are band shaped.

10. The tuner apparatus according to claim 9, wherein the center region and the second center region are thinner than the first connecting region and the second connecting region.

11. The tuner apparatus according to claim 10, wherein the center region and the second center region have planar side faces.

12. The tuner apparatus according to claim 10, wherein the torsionally deflecting member has a first connecting region, a second connecting region and a center region, said center region joins the first connecting region and the second connecting region and is torsionally deflectable.

13. The tuner apparatus according to claim 12, wherein said second connecting region includes two connecting regions which are joined to the first connecting region by the center region and a second center region, said second center region is torsionally deflectable.

14. The tuner apparatus according to claim 13, wherein the center region and the second center region are band shaped.

15. The tuner apparatus according to claim 14, wherein the center region and the second center region are thinner than the first connecting region and the second connecting region.

16. The tuner apparatus according to claim 15, wherein the center region and the second center region have planar side faces.

17. The tuner apparatus according to claim 13, wherein the fulcrum and the movable connecting cite have substantially the same configuration.

18. The tuner apparatus according to claim 1, wherein the first lever member has formed integrally therewith a deflectable fulcrum member a deflectable narrow cross member.

* * * * *